US010273071B2

(12) United States Patent
Windelinckx et al.

(10) Patent No.: US 10,273,071 B2
(45) Date of Patent: Apr. 30, 2019

(54) HOT-FILLABLE PLASTIC CONTAINER HAVING VERTICAL PILLARS AND CONCAVE DEFORMABLE SIDE-WALL PANELS

(71) Applicant: PLASTIPAK BAWT, S.A.R.L., Bascharage (LU)

(72) Inventors: Steve Windelinckx, Zoersel (BE); Alain Dessaint, Kampenhout (BE)

(73) Assignee: Plastipak BAWT S.á.r.l., Bascharage (LU)

( * ) Notice: Subject to any disclaimer, the term of this patent is extended or adjusted under 35 U.S.C. 154(b) by 0 days.

(21) Appl. No.: 14/421,961

(22) PCT Filed: Aug. 14, 2013

(86) PCT No.: PCT/EP2013/066996
§ 371 (c)(1),
(2) Date: Feb. 16, 2015

(87) PCT Pub. No.: WO2014/027027
PCT Pub. Date: Feb. 20, 2014

(65) Prior Publication Data

US 2015/0203268 A1 Jul. 23, 2015

(30) Foreign Application Priority Data

Aug. 16, 2012 (EP) ..... 12180697

(51) Int. Cl.
*B65D 79/00* (2006.01)
*B65D 1/02* (2006.01)
(Continued)

(52) U.S. Cl.
CPC ..... *B65D 79/005* (2013.01); *B65B 3/04* (2013.01); *B65D 1/0223* (2013.01);
(Continued)

(58) Field of Classification Search
CPC ..... B65D 79/005; B65D 1/0223; B65D 1/40; B65D 23/00; B65D 90/02
See application file for complete search history.

(56) References Cited

U.S. PATENT DOCUMENTS 5,005,716 A 4/1991 Eberle
5,092,475 A 3/1992 Krishnakumar et al.
(Continued)

FOREIGN PATENT DOCUMENTS

EP 1947016 A2 7/2008
EP 2138407 A1 12/2009

*Primary Examiner* — Andrew T Kirsch
(74) *Attorney, Agent, or Firm* — Fishman Stewart PLLC

(57) ABSTRACT

A hot-fillable plastic container includes a base and a body extending upward from the base. The includes a deformable cylindrical sidewall portion defining a central vertical axis, wherein the deformable cylindrical sidewall portion comprises at least two vertical pillars arranged along the body circumference. Each vertical pillar is joined to the next vertical pillar by a generally concave deformable sidewall panel having a concave arc-shaped transverse cross section of curvature radius. The curvature radii of the vertical pillars are smaller than the curvature radii of the generally concave deformable panels, and each transition between a vertical pillar and a generally concave deformable panel is smooth without any convex portion. The large curvature radius of each generally concave deformable panel allows an inward deformation of each panel, and each pillar is slightly pushed outward and is slightly deformed with a small reduction of its curvature radius, under the vacuum created inside the container by the volume reduction of a hot-filled product during cooling.

23 Claims, 8 Drawing Sheets

(51) Int. Cl.
*B65B 3/04* (2006.01)
*B65D 1/40* (2006.01)

(52) U.S. Cl.
CPC ..... *B65D 1/0276* (2013.01); *B65D 1/40* (2013.01); *B65D 2501/0018* (2013.01); *B65D 2501/0027* (2013.01); *B65D 2501/0036* (2013.01)

(56) References Cited

U.S. PATENT DOCUMENTS 5,141,121 A 8/1992 Brown et al.
5,178,289 A 1/1993 Krishnakumar et al.
5,222,615 A 6/1993 Ota et al.
5,303,834 A 4/1994 Krishnakumar et al.
5,392,937 A 2/1995 Prevot et al.
5,407,086 A 4/1995 Ota et al.
5,503,283 A 4/1996 Semersky
5,598,941 A 2/1997 Semersky et al.
5,704,504 A 1/1998 Bueno
5,762,221 A 6/1998 Tobias et al.
5,971,184 A 10/1999 Krishnakumar et al.
6,044,996 A 4/2000 Carew et al.
6,554,146 B1 4/2003 DeGroff et al.
6,585,125 B1 7/2003 Peek
6,595,380 B2 7/2003 Silvers
6,662,961 B2 12/2003 Yourist
6,698,606 B2 3/2004 Deubel et al.
6,796,450 B2 9/2004 Prevot et al.
6,830,158 B2 12/2004 Yourist
6,837,390 B2 * 1/2005 Lane ..... B65D 1/0223 215/381
6,896,147 B2 5/2005 Trude
6,942,116 B2 9/2005 Lisch et al.
7,017,763 B2 3/2006 Kelley
7,673,764 B2 * 3/2010 Sabold ..... B65D 1/44 215/365
7,815,064 B2 * 10/2010 Howell ..... B65D 1/0223 215/381
2003/0000911 A1 1/2003 Kelley et al.
2003/0015491 A1 1/2003 Melrose et al.
2004/0144748 A1 * 7/2004 Slat ..... B65D 1/0276 215/382
2006/0138074 A1 * 6/2006 Melrose ..... B65D 1/0276 215/373
2007/0257004 A1 11/2007 Howell et al.
2012/0111824 A1 5/2012 Ungrady et al.

* cited by examiner

HOT-FILLABLE PLASTIC CONTAINER HAVING VERTICAL PILLARS AND CONCAVE DEFORMABLE SIDE-WALL PANELS

TECHNICAL FIELD

The present invention relates to a novel plastic container, that is adapted to be hot-filled with a product, and more particularly with a food product, and which has a deformable structure for at least partially compensating the volume reduction that occurs after capping and during cooling of a hot-filled product.

PRIOR ART

Plastic containers intended to be hot-filled and designed therein as "hot-fillable" containers, such as for example PET (polyethylene terephtalate) blow molded hot-fillable containers are generally designed in order to have a deformable structure adapted to at least partially compensating the volume reduction that occurs after capping and during cooling of a hot-filled product. Such a volume reduction is due to the partial vacuum created inside the container by the cooling of the hot-filled product.

Plastic hot-fillable containers are for example described in the following publications: U.S. Pat. Nos. 5,005,716; 5,503,283; 6,595,380; 6,896,147; 6,942,116; and 7,017,763. In these publications, a deformable portion, to at least partially compensating the volume reduction that occurs after capping and during cooling of a hot-filled product, is located in the base of the container.

Plastic hot-fillable containers are also described for example in the following publications: European patent application EP 1 947 016 and U.S. Pat. Nos. 5,222,615; 5,762,221; 6,044,996; 6,662,961; 6,830,158. In these publications, a deformable portion, to at least partially compensating the volume reduction that occurs after capping and during cooling of a hot-filled product, is located in the shoulder part of the container.

When the deformable portion is located in the base or in the shoulder part of the container, the volume compensation is prejudicially very limited.

Moreover, in the technical solution proposed in European patent application EP 1 947 016 wherein the deformable portion is located in the shoulder part of the container, the mechanical top load of the container is prejudicially very poor.

Plastic hot-fillable containers are also described for example in the following publications: U.S. Pat. Nos. 5,092,475; 5,141,121; 5,178,289; 5,303,834; 5,704,504; 6,585,125; 6,698,606; 5,392,937; 5,407,086; 5,598,941; 5,971,184; 6,554,146; 6,796,450. In these publications, the deformable portion, to at least partially compensating the volume reduction that occurs after capping and during cooling of a hot-filled product, is located in the sidewall of the main body of the container. In this case, the volume compensation can be advantageously increased. But the deformable features of the containers, typically circumferential ribs or deformable panels in the container sidewall, are quite unaesthetic.

Moreover, the deformable sidewall of the containers often causes labeling problems, due to the deformation of the container in a part of the container where a label is usually applied and surrounds the container body.

OBJECTIVE OF THE INVENTION

A main objective of the invention is to propose a hot-fillable container, that exhibits a good mechanical top load, and that has a novel deformable structure in the sidewall of the container body to at least partially compensating the volume reduction that occurs after capping and during cooling of a hot-filled product, without impairing the aesthetic of the container.

Another auxiliary objective is to propose a hot-fillable container wherein the novel deformable structure in the sidewall of the container body still enables to label the container with a label surrounding the container body.

SUMMARY OF THE INVENTION

The invention thus relates to a hot-fillable plastic container defined in claim 1.

This hot hot-fillable plastic container comprises a base and a body extending upward from the base; the body comprises a deformable cylindrical sidewall portion defining a central vertical axis; said deformable cylindrical sidewall portion comprises at least two vertical pillars arranged along the body circumference; each vertical pillar has a concave arc-shaped transverse cross section of curvature radius (r) or has a central portion extended laterally at both extremities by a concave portion having a concave arc-shaped transverse cross section of curvature radius (r); each vertical pillar is joined to the next vertical pillar by a generally concave deformable sidewall panel having a concave arc-shaped transverse cross section of curvature radius (R); the curvature radii (r) of the vertical pillars are smaller than the curvature radii (R) of the generally concave deformable panels, and each transition between a vertical pillar and a generally concave deformable panel is smooth without any convex portion. The large curvature radius (R) of each generally concave deformable panel allows an inward deformation of each panel, and each pillar is slightly pushed outward and is slightly deformed with a small reduction of its curvature radius (r), under the vacuum created inside the container by the volume reduction of a hot-filled product during cooling.

The invention also relates to a process for packaging a product, wherein said the aforesaid hot-fillable plastic container is being been hot-filled with said product at a temperature above room temperature, and more particularly at a temperature above 80° C.

BRIEF DESCRIPTION OF THE DRAWINGS

Other characteristics of the invention will appear more clearly on reading the following detailed description which is made by way of non-exhaustive and non-limiting example, and with reference to the accompanying drawings, in which.

DETAILED DESCRIPTION

Some preferred embodiments of the invention are discussed in detail below. While specific exemplary embodiments are discussed, it should be understood that this is done for illustration purpose only. A person skilled in the art will recognize that other container designs or container dimensions can be used without parting from the spirit and scope of the invention.

Figure 1:
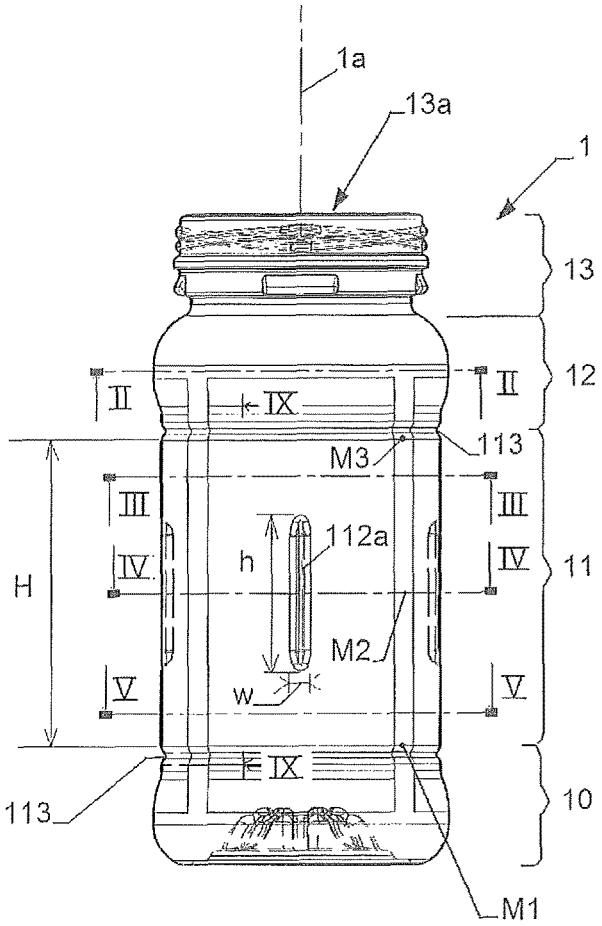
FIG. 1 is a side view of an empty hot-fillable plastic container pursuant to a first embodiment (four pillars) of the invention.
Figure 2:
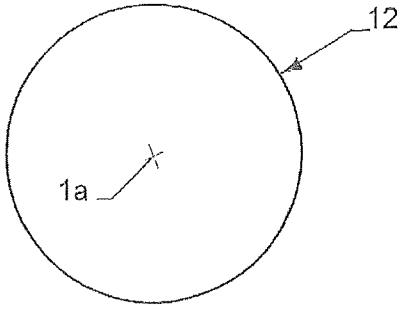
FIG. 2 is a transverse cross section in plane II-II of the container of FIG. 1.

Referring now to the drawings, FIG. 1 illustrates a blow-molded hot-fillable plastic container 1, for example made of a polyester material, like PET, that is intended to be filled with a hot liquid at a temperature above room temperature (i.e. above 25° C.), such as for example tomato sauce or the like, jelly, jam or preserves.

In this particular embodiment of FIG. 1, the blow-molded hot-fillable plastic container 1 defines a central vertical axis 1*a*, and comprises a base 10, a body 11 extending upward from the base, a shoulder portion 12 extending upward from the body 11, and a top finish portion 13 having a pouring opening 13*a*.

The body 11 forms a cylindrical sidewall portion 110 of height H, which is deformable under a vacuum created inside the container by the volume reduction of a hot-filled product that occurs after capping and cooling of the hot-filled product. Said deformation of the cylindrical sidewall portion 110 is adapted to at least partially compensating this volume reduction.

Figure 3:
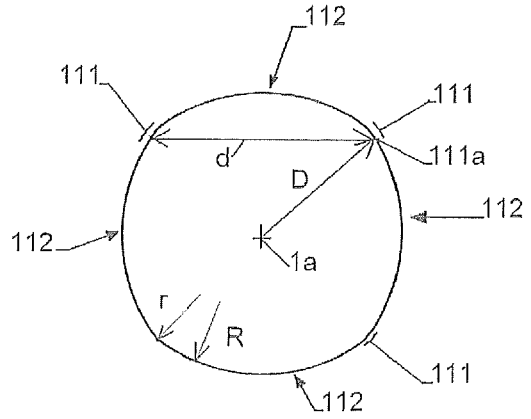
FIG. 3 is a transverse cross section in plane III-III of the container of FIG. 1.
Figure 4:
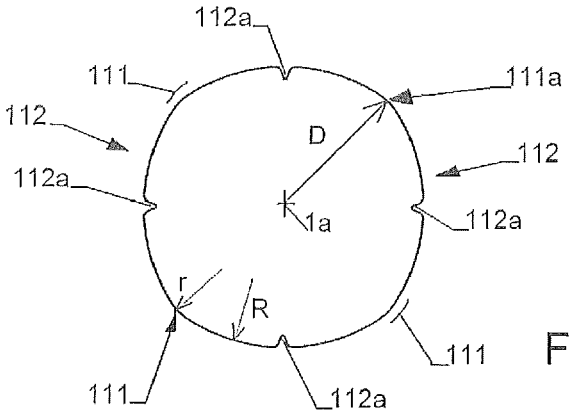
FIG. 4 is a transverse cross section in plane IV-IV of the container of FIG. 1.
Figure 5:
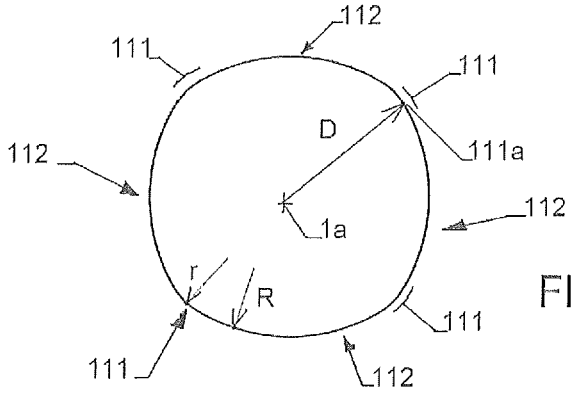
FIG. 5 is a transverse cross section in plane V-V of the container of FIG. 1.

In the particular embodiment of FIG. 1, and in reference to the transverse cross sections of FIGS. 3 to 5, the deformable cylindrical sidewall portion 110 comprises four concave vertical pillars 111 arranged regularly along the container circumference and extending over the whole height H, each vertical concave pillar 111 being joined to a next vertical concave 111 pillar by a generally concave deformable sidewall panel 112. For each vertical pillar 111, the distance D measured between the apex 111*a* of the outer surface of the pillar 111 and the vertical central axis 1*a*, in a transverse plan perpendicular to the vertical central axis 1*a* (FIGS. 3, 4, 5), is substantially constant over the whole height H of the pillar.

Each concave vertical pillar 111 has an arc-shaped transverse cross section of small curvature radius r, measured in a transversal cross-section plan perpendicular to the central axis 1*a* (FIGS. 3, 4 and 5); each generally concave deformable sidewall panel 112 has an arc-shaped transverse cross section of larger curvature radius R (r<R) measured in the said transversal cross-section plan.

In addition, the transition between each vertical concave pillar 111 and each generally concave deformable panel 112 is smooth without any convex portion.

The small curvature radius r of each vertical concave pillar 111 has been determined in order to stiffen and render each pillar 111 only slightly deformable with a small reduction of its curvature radius r, under a vacuum created inside the container by the volume reduction of a hot-filled product during cooling. These pillars 111 dramatically improve the mechanical top load of the container.

In contrast the large curvature radius R of each concave deformable panel 112 has been determined in order to allow an inward deformation of each panel 112 under the vacuum created inside the container by the volume reduction of a hot-filled product during cooling.

Figure 6:
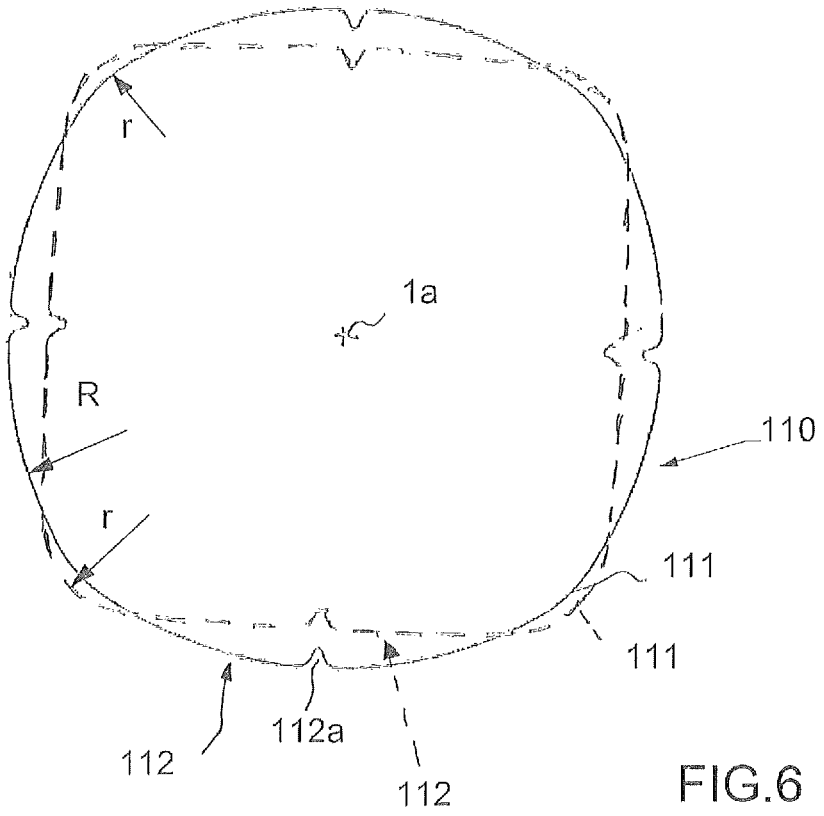
FIG. 6 is a transverse cross section in plane IV-IV of the container of FIG. 1 showing in dotted line a first example of deformation of the container.

More especially, in reference to FIG. 6, the geometry of the hot-filled container 1, after capping and cooling, is depicted in dotted lines. When the container 1 is hot-filled with a product (liquid or the like) and is cooled after capping, the volume reduction of the cooled product creates a partial vacuum within the container. This vacuum deforms the sidewalls panels 112 that move inwardly with an increase of their curvature radius R. For example, as depicted on FIG. 6 the sidewall panels 112, after deformation, are substantially flat and forms linear segments. In contrast, the pillars 111 are slightly pushed outward with a small reduction of their curvature radius r.

Figure 7:
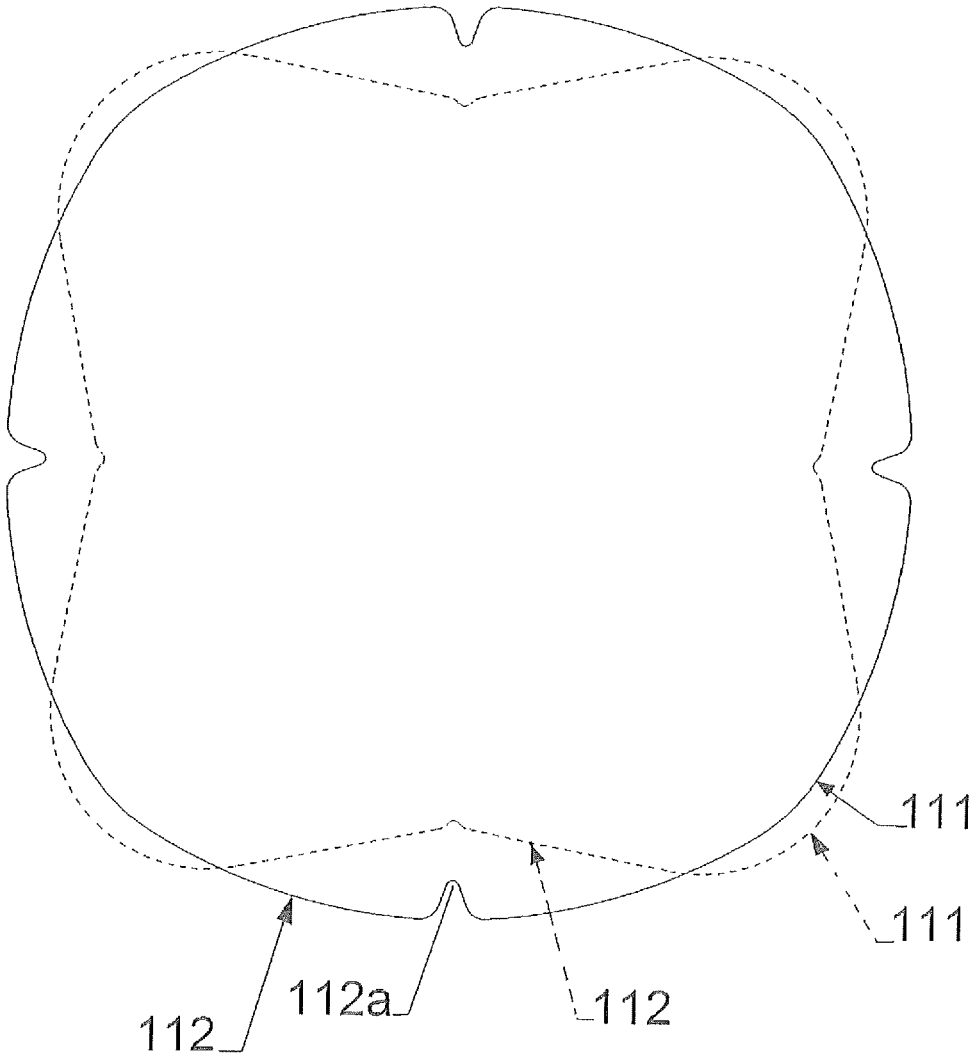
FIG. 7 is a transverse cross section in plane IV-IV of the container of FIG. 1 showing in dotted line a second example of deformation of the container.

In some cases, when the volume reduction of the product upon cooling is more important, the sidewalls panels 112 can be more strongly deformed under vacuum in such way to become convex, as depicted on the particular configuration of FIG. 7.

One skilled in the art will knowingly define the specific values of the curvatures radii r and R to achieve the appropriate deformation of the container. Typically, in most cases, the ratio R/r will be higher than 2, and more particularly higher than 2.5.

By way of example only, in one specific example the container 1 is made of PET and the deformable portion 11 has a substantially constant wall thickness of about 0.60 mm; the curvature radius r is about 15 mm and the curvature radius R is about 44 mm; the internal volume reduction that can be obtained by deformation of the cylindrical deformable body 11 of the container was approximately 3% or more of the initial internal volume of the empty container.

Figure 10:
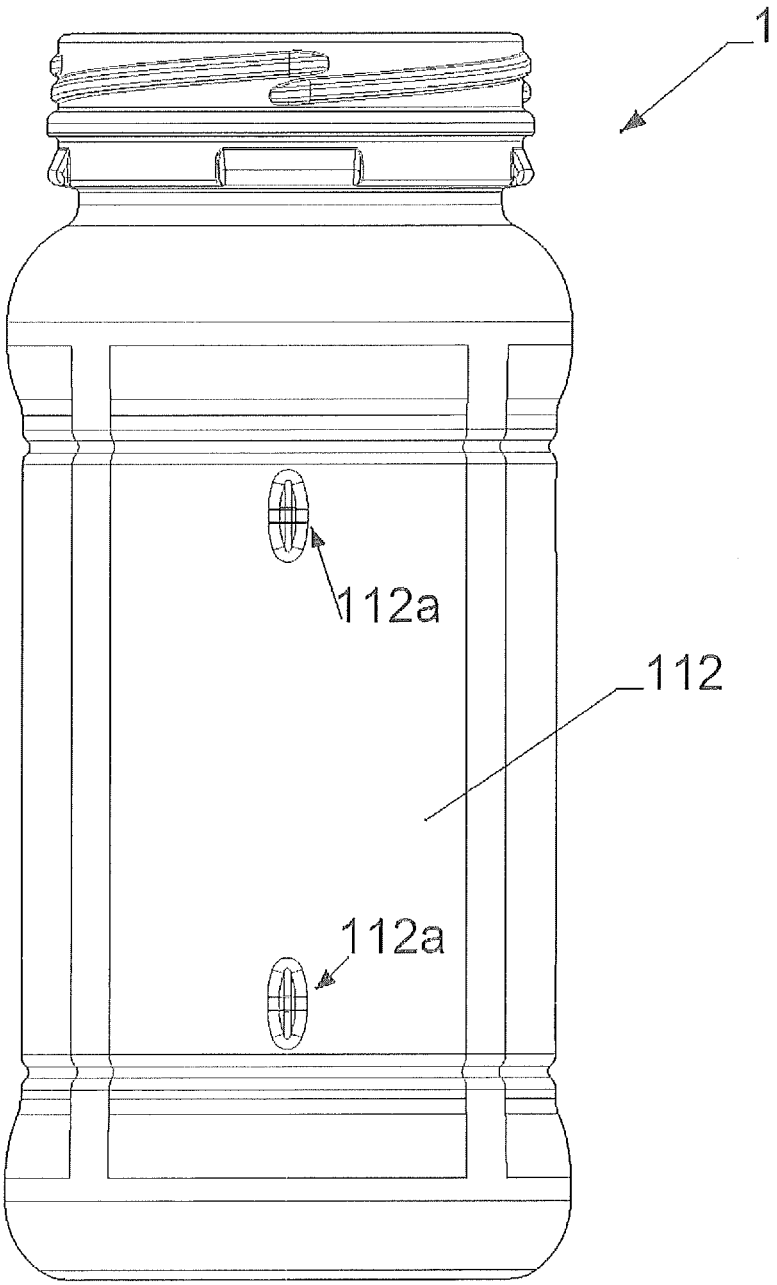
FIG. 10 is a side view of an empty hot-fillable plastic container pursuant to a third embodiment of the invention.

In the particular embodiment of FIG. 1, each deformable sidewall panel 112 comprises at mid-height a central small vertical rib 112*a* of small height h (h<H), that facilitates the inward deformation of the sidewall panel 112. Preferably, the width w of each rib is very small and the height h of each rib 112*a* is less than 50% of the total height H of the panel 112. In another variant, the ribs 112*a* can be positioned differently, and for example a small central rib 112*a* can be provided in each sidewall panel 112 near the base 10 and/or a small central rib 112*a* can be provided in each sidewall panel 112 near the shoulder portion 12, as depicted for example in the embodiment of FIG. 10. In another variant, the ribs 112*a* could be omitted.

The deformable cylindrical sidewall portion 11 of the container has advantageously a smooth outer surface (except only in the small areas of the ribs 112*a*), which gives a pure and aesthetic design to the container, while conferring to this container a deformable capacity under internal vacuum.

In addition, the empty container 1 can labeled with a label surrounding the container body 11, and the deformation of the hot-filled container body 11 that occurs during cooling does not deteriorate the label.

In the particular example of the empty container of FIGS. 1 to 5, the deformable panels 112 have the same dimensions, and more particularly the same width (i.e. distance d between two pillars 111 in a transverse plan). In another variant however, the distance d between the pillars 111 in a transverse plan is not necessary constant and the deformable panels 112 can thus have different widths.

In the particular example of the empty container of FIGS. 3 to 5, all the pillars 111 have the same curvature radius r, and all the deformable panels 112 have the same curvature radius R. In another variant, the pillars 111 can however have different curvature radii r measured in the same transverse plan. In another variant, the deformable panels 112 can however have different curvature radii R measured in the same transverse plan.

Within the scope of the invention the curvature radius r of one pillar 111 can be constant over the whole pillar height H, or can vary. More particularly, in particular variant, the curvature radius r of one pillar 111 is increasing from the junction M1 with the base 10 towards an intermediary point M2, preferably located at mid-height of the pillar 111, and is then decreasing from this intermediary point M2 towards the junction M3 with the shoulder portion 12. In another particular variant, the curvature radius r of one pillar 111 is decreasing from the junction M1 with the base 10 towards an intermediary point M2, preferably located at mid-height of the pillar 111, and is then increasing from this intermediary point M2 towards the junction M3 with the shoulder portion 12

Figure 8:
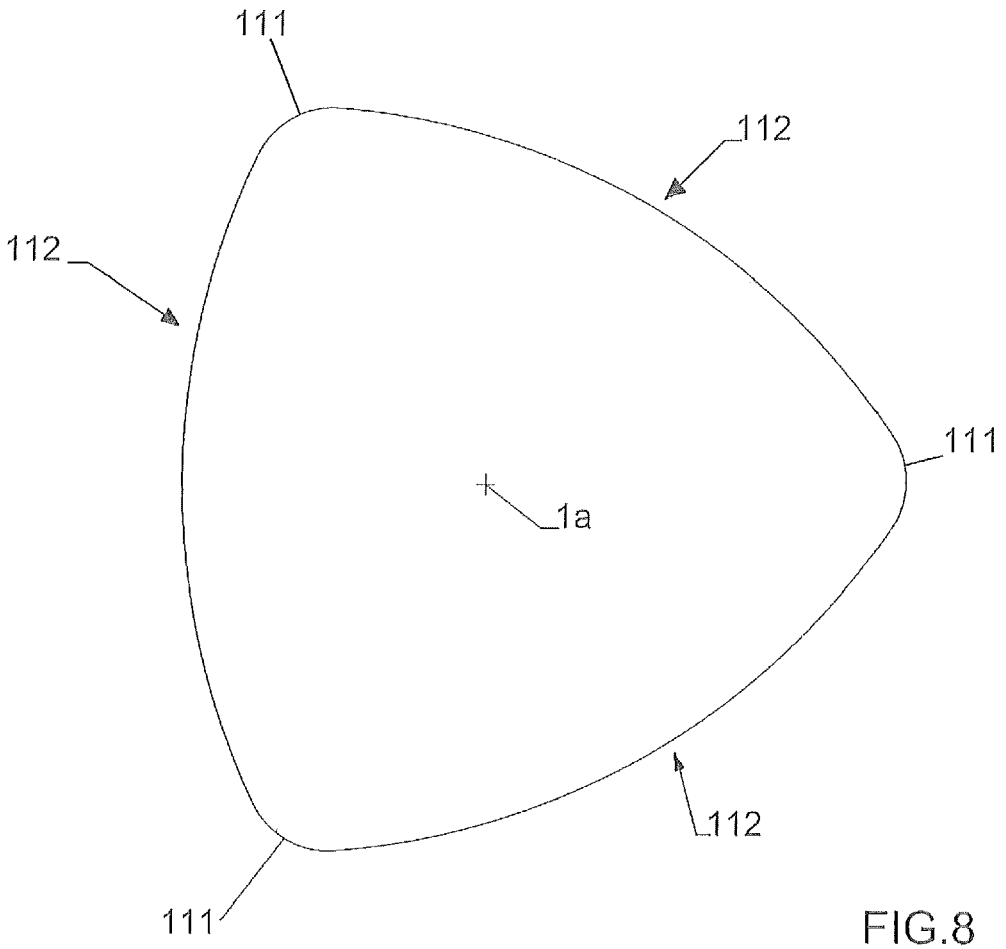
FIG. 8 is a transverse cross section view of an empty hot-fillable plastic container pursuant to a second embodiment (three pillars) of the invention

The invention is not limited to a container having four pillars 112. In another variant, the container can have two pillars or three pillars like the embodiment of FIG. 8, or can have more than four pillars.

Figure 9:
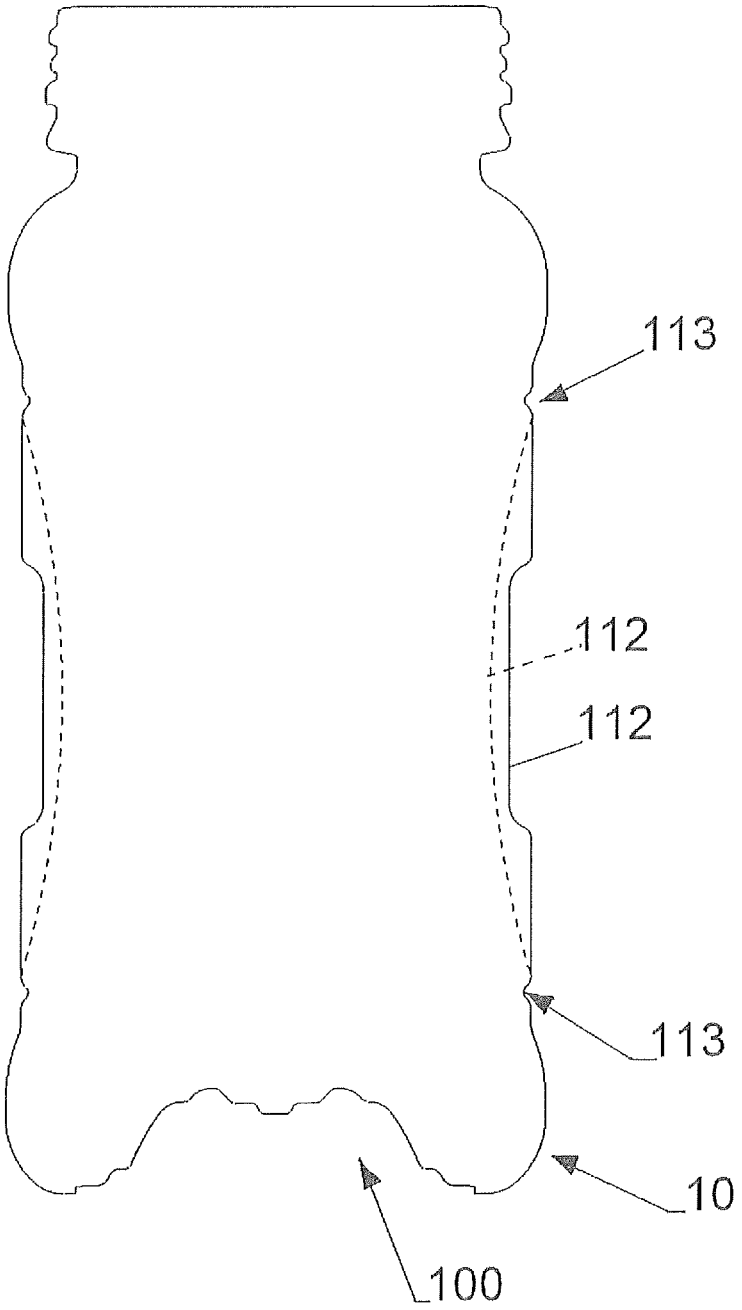
FIG. 9 is a longitudinal cross section of the container of FIG. 1 in plane IX-IX showing in dotted line an example of longitudinal deformation of the container.

In reference to the particular embodiment of FIG. 9, the longitudinal profile, measured in a longitudinal plan parallel to the vertical central axis 1*a*, of each deformable panel 112 at rest (i.e. when the container 1 is empty) is substantially linear. When the panel 112 is deformed under vacuum within the hot-filled container, the panel 112 deforms longitudinally between the shoulder portion 12 and the base 10, in such a way to have a convex arc shape as depicted in dotted line on FIG. 10. Preferably, in order to facilitate this longitudinal deformation of the panels 112, a small circumferential rib 113 is provided at the upper end of the of the deformable cylindrical sidewall portion (11), and at the bottom end of the of the deformable cylindrical sidewall portion (11).

In this variant of FIG. 9, the base 10 of the container is a champagne base comprising a central inward dome-shaped portion 100, in order to have an increased mechanical strength and higher resistance to distortion.

In another variant the longitudinal profile of each deformable panel 112 at rest is not necessarily linear, but can form at rest a convex arc or a concave arc.

Figure 11:
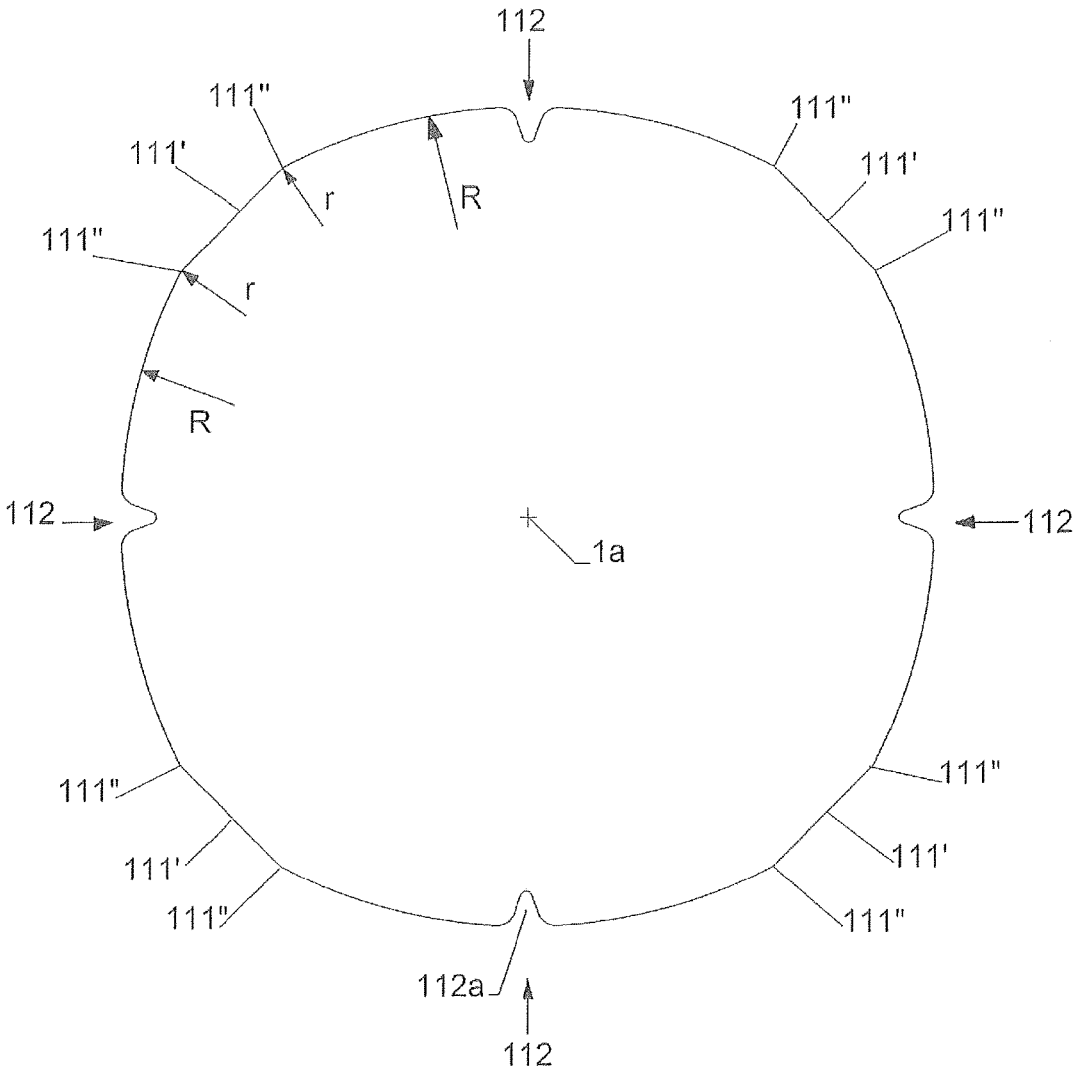
FIG. 11 is a transverse cross section view of an empty hot-fillable plastic container pursuant to a fourth embodiment of the invention.

In the variant of FIG. 11, each vertical pillar 111 has a central portion 111' extended laterally at both extremities by two concave portions 111" having a concave arc-shaped transverse cross section of curvature radius r. In this variant, the curvature radii r of the two concave portions 111" are equal. In another variant, the curvature radii r of the two concave portions 111" can be different. In the particular variant of FIG. 11, the central portion 111' of each pillar 111 is substantially flat. This central portion 111' is however not necessary flat, and can have any curved profile in cross section.

The invention claimed is:

1. A hot-fillable plastic container comprising:

a base; and a body extending upward from the base, wherein the body comprises a deformable cylindrical sidewall portion defining a central vertical axis, wherein said deformable cylindrical sidewall portion comprises at least three vertical pillars arranged regularly along the body circumference, wherein each vertical pillar has a concave arc-shaped transverse cross section of curvature radius (r) or has a central portion extended laterally at extremities of the central portion by a concave portion having a concave arc-shaped transverse cross section of curvature radius (r), wherein each of the at least three vertical pillars is joined to the next of the at least three vertical pillars by a generally concave deformable panel having a concave arc-shaped transverse cross section of curvature radius (R), wherein a central portion of the vertical pillar has a middle portion extended laterally at both extremities by concave portions and the central portion is substantially flat, wherein the curvature radii (r) of the vertical pillars are smaller than the curvature radii (R) of the generally concave deformable panels, transitions are provided between the vertical pillar and the generally concave deformable panel, and each transition between the vertical pillar and the generally concave deformable panel is smooth without any convex portion, wherein a large curvature radius (R) of each generally concave deformable panel allows an inward deformation of each panel, and each of the at least three vertical pillars is slightly pushed outward and is slightly deformed with a small reduction of its curvature radius (r), under the vacuum created inside the container by the volume reduction of a hot-filled product during cooling.

2. The hot-fillable plastic container of claim 1, further comprising a shoulder portion extending upward from the body, and a top finish portion extending upward from the shoulder portion and comprising a pouring opening.

3. The hot-fillable plastic container of claim 1, wherein for each of the at least three vertical pillars, a distance measured between an apex of an outer surface of the pillar and a vertical central axis, in a transverse plan perpendicular to the vertical central axis, is substantially constant over the whole height of the pillar.

4. The hot-fillable plastic container of claim 1, wherein the at least three vertical pillars comprise three vertical pillars.

5. The hot-fillable plastic container of claim 1, wherein the at least three vertical pillars comprise four vertical pillars.

6. The hot-fillable plastic container of claim 1, wherein each generally concave deformable panel is adapted to become substantially flat and form a linear segment, after deformation.

7. The hot-fillable plastic container of claim 1, wherein a ratio (R/r) between the curvature radius (R) of a generally concave deformable panel and a curvature radius (r) of each vertical pillar adjacent to the concave deformable panel is higher than 2.

8. The hot-fillable plastic container of claim 1, wherein the generally concave deformable panel comprises a small inwardly-extending central vertical rib for facilitating an inward deformation of the generally concave deformable panel.

9. The hot-fillable plastic container of claim 8, wherein the small inwardly-extending central vertical rib is located at mid-height of the generally concave deformable panel.

10. The hot-fillable plastic container of claim 8, wherein each generally concave deformable panel has a smooth outer surface, excepting a small area of the small inwardly-extending central vertical rib.

11. The hot-fillable plastic container of claim 1, wherein the generally concave deformable panel comprises a small inwardly extending central vertical rib located near the base for facilitating the inward deformation of the generally concave deformable panel and/or a small central vertical rib located near a shoulder portion for facilitating the inward deformation of the generally concave deformable panel.

12. The hot-fillable plastic container of claim 11, wherein the height of the small central vertical rib is less than 50% of the total height of the generally concave deformable panel.

13. The hot-fillable plastic container of claim 1, wherein the distance between the at least three vertical pillars measured in a transverse plan perpendicular to the central vertical axis is substantially constant.

14. The hot-fillable plastic container of claim 1, wherein, each of the at least three vertical pillars have the same curvature radius (r).

15. The hot-fillable plastic container of claim 1, wherein all the generally concave deformable panels have the same curvature radius (R).

16. The hot-fillable plastic container of claim 1, wherein the curvature radius (r) of at least one vertical pillar is constant over the whole pillar height.

17. The hot-fillable plastic container of claim 1, wherein the curvature radius (r) of at least one vertical pillar is decreasing from the junction with the base towards an intermediary point and is then increasing from this intermediary point towards the junction with the shoulder portion.

18. The hot-fillable plastic container of claim 1, further comprising a circumferential rib at an upper end of the deformable cylindrical sidewall portion and a circumferential rib at a bottom end of the deformable cylindrical sidewall portion.

19. The hot-fillable plastic container of claim 1, wherein the internal volume reduction that can be obtained by deformation of the body of the container is 3% or more of an initial internal volume of the empty container.

20. The hot-fillable plastic container of claim 1, wherein the base is a champagne base.

21. A process for packaging a product wherein a hot-fillable plastic container of claim 1 is being hot-filled with said product at a temperature above room temperature.

22. The process of claim 21, wherein the hot-fillable plastic container is being hot-filled with said product at a temperature above 80° C.

23. A hot-fillable plastic container comprising:

a base; and a body extending upward from the base, wherein the body comprises a deformable cylindrical sidewall portion defining a central vertical axis, wherein said deformable cylindrical sidewall portion comprises at least three vertical pillars arranged regularly along the body circumference, wherein each vertical pillar has a concave arc-shaped transverse cross section of curvature radius (r) or has a central portion extended laterally at extremities of the central portion by a concave portion having a concave arc-shaped transverse cross section of curvature radius (r), wherein each of the at least three vertical pillars is joined to the next of the at least three vertical pillars by a generally concave deformable panel having a concave arc-shaped transverse cross section of curvature radius (R), wherein the curvature radii (r) of the vertical pillars are smaller than the curvature radii (R) of the generally concave deformable panels, transitions are provided between the vertical pillar and the generally concave deformable panel, and each transition between the vertical pillar and the generally concave deformable panel is smooth without any convex portion, wherein a large curvature radius (R) of each generally concave deformable panel allows an inward deformation of each panel, and each of the at least three vertical pillars is slightly pushed outward and is slightly deformed with a small reduction of its curvature radius (r), under the vacuum created inside the container by the volume reduction of a hot-filled product during cooling, wherein the generally concave deformable panel comprises a small inwardly extending central vertical rib located near the base for facilitating the inward deformation of the generally concave deformable panel and/or a small central vertical rib located near a shoulder portion for facilitating the inward deformation of the generally concave deformable panel, and the height of the small central vertical rib is less than 50% of the total height of the generally concave deformable panel.

* * * * *